US007413287B2

(12) United States Patent
Sugahara

(10) Patent No.: US 7,413,287 B2
(45) Date of Patent: Aug. 19, 2008

(54) LIQUID DISCHARGING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 24 days.

(21) Appl. No.: 11/476,772

(22) Filed: Jun. 29, 2006

(65) Prior Publication Data

US 2007/0001034 A1 Jan. 4, 2007

(30) Foreign Application Priority Data

Jun. 30, 2005 (JP) ..... 2005-191439

(51) Int. Cl.
*B41J 2/05* (2006.01)

(52) U.S. Cl. ..... 347/56

(58) Field of Classification Search ..... 347/199, 347/54, 55, 56, 65

See application file for complete search history.

(56) References Cited

U.S. PATENT DOCUMENTS

| | | | | |
|---|---|---|---|---|
| 4,751,532 | A * | 6/1988 | Fujimura et al. | 347/55 |
| 4,752,782 | A * | 6/1988 | Saito et al. | 347/55 |
| 5,854,644 | A * | 12/1998 | Eun | 347/54 |
| 5,943,074 | A * | 8/1999 | Kashino et al. | 347/54 |
| 6,406,131 | B2 | 6/2002 | Lerat et al. | |
| 6,926,382 | B2 | 8/2005 | Ito et al. | |
| 2005/0219330 | A1 | 10/2005 | Sugahara | |

FOREIGN PATENT DOCUMENTS

| | | |
|---|---|---|
| EP | 0940255 A1 | 9/1999 |
| EP | 1582351 A1 | 10/2005 |
| JP | 2003 177219 | 6/2003 |
| JP | 2003 326712 | 11/2003 |
| JP | 2005 59215 | 3/2005 |

OTHER PUBLICATIONS

European Patent Office, European Search Report in European Patent Appl'n No. 06013514.2-1251 (counterpart to above-captioned US patent appl'n) dated Jan. 22, 2008.

* cited by examiner

*Primary Examiner*—K. Feggins
(74) *Attorney, Agent, or Firm*—Baker Botts L.L.P.

(57) ABSTRACT

A liquid discharging apparatus includes a plurality of liquid channels each having a discharge port, a control electrode extended on a surface defining the liquid channel from the discharge port toward an upstream side in a direction of flow of a liquid, an insulating film which coats the control electrode, and an electric potential control section which controls an electric potential of the control electrode with respect to the liquid. When a predetermined electric potential difference are set between the liquid and the control electrode, a liquid repellence of a surface of the insulating film is lowered due to an electrowetting phenomenon so that the liquid can move toward the discharge port on an area of the liquid channel in which the insulating film is formed. Accordingly, it is possible to provide the liquid discharging apparatus which is capable of discharging a liquid by a simple structure.

14 Claims, 15 Drawing Sheets

LIQUID DISCHARGING APPARATUS

CROSS REFERENCE TO RELATED APPLICATION

The present application claims priority from Japanese Patent Application No. 2005-191439, filed on Jun. 30, 2005, the disclosure of which is incorporated herein by reference in its entirety.

BACKGROUND OF THE INVENTION

1. Field of the Invention

The present invention relates to a liquid discharging apparatus which discharges a liquid.

2. Description of the Related Art

An ink-jet head which discharges ink (liquid) on to a paper or the like is an example of a printing apparatus (ink discharging apparatus) which prints on a printing medium such as a paper. There are various types of such ink-jet heads, such as an ink-jet head which is provided with a channel unit including a plurality of ink channels such as a pressure chamber communicating with a nozzle, and a piezoelectric actuator unit which applies pressure to ink in the pressure chamber (refer to FIG. 1 of U.S. Pat. No. 6,926,382 (corresponds to FIG. 1 of Japanese Patent Application Laid-open Publication No. 2003-326712)). A normal piezoelectric actuator unit includes a plurality of individual electrodes corresponding to each of pressure chambers communicating with the nozzles, a common electrode facing the individual electrodes, and a piezoelectric layer made of lead zirconate titanate (PZT) which is sandwiched between the individual electrode and the common electrode. Further, when a drive voltage is supplied to a desired individual electrode, an electric field is generated in a part of the piezoelectric layer sandwiched between the individual electrode and the common electrode, and the piezoelectric layer is partially deformed. As the piezoelectric layer is deformed, a pressure is applied to the ink in the pressure chamber, and the ink is discharged from a nozzle communicating with the pressure chamber.

SUMMARY OF THE INVENTION

However, since a structure of an ink-jet head mentioned above is quite complicated, the manufacturing cost is increased. Moreover, for discharging a fixed amount of ink, it is necessary to make a volume of the pressure chamber greater than a predetermined volume. Therefore, even in a case where it is necessary to provide a plurality of nozzles (pressure chambers) to the ink-jet head, it is difficult to form densely a plurality of individual ink channels including the nozzles and the pressure chambers, thereby making it difficult to reduce a size of the ink-jet head.

An object of the present invention is to provide a liquid discharging apparatus which is capable of discharging a liquid by a simple structure.

According to a first aspect of the present invention, there is provided a liquid discharging apparatus which discharges a liquid having an electroconductivity, including:

a liquid channel having a discharge port, through which the electroconductive liquid flows;

an electrode which is formed on a predetermined surface of the liquid channel, and which is extended from the discharge port toward an upstream side of a direction of a flow of the liquid;

an insulating film which is extended from the discharge port, toward the upstream side of the direction of flow, on the predetermined surface of the liquid channel, and which is formed on a predetermined surface of the liquid channel entirely in a width direction orthogonal to the direction of flow, and which covers the electrode;

an adjacent area which is adjacent to the insulating film on the predetermined surface of the liquid channel on the upstream side of the direction of flow; and an electric potential control mechanism which controls an electric potential of the electrode, and a liquid repellence of the insulating film is higher than a liquid repellence of the adjacent area.

According to the first aspect of the present invention, by controlling the electric potential of the electrode by the electric potential control mechanism, it is possible to control an amount and a speed of the liquid discharged from the discharge port, by an electrowetting effect which will be described later. Consequently, it is possible to provide at a low cost the liquid discharging apparatus having a simple structure and a high degree of integration. Moreover, since an energy required for discharging the liquid from the discharge port is low, it is possible to reduce a size and a cost of electric components. Here, an electrowetting phenomenon is a phenomenon in which, in a case of an electrode and an electroconductive liquid insulated by an insulating film electrically connected to the electrode, when a voltage is applied between the electrode and the liquid, a contact angle (wetting angle) between a surface of the insulating film and the liquid is decreased as compared to a case when there is no electric potential difference between the electrode and the liquid. In other words, when the voltage is applied between the electrode and the liquid, the liquid repellence of the surface of the insulating film is lowered as compared to the case in which there is no electric potential difference between the electrode and the liquid (reference: Patent literature: Japanese Patent Application Laid-open Publication No. 2003-177219).

In the present invention, a position of the insulating film and the electrode is described to be "extended from the discharge port toward the upstream side in the direction of flow", which also includes a case in which an edge of the insulating film and the electrode, on an downstream side in the direction of flow is slightly away from the discharge port, and furthermore, also includes a case in which, when the electrode is let to be at a first electric potential, the liquid cannot be stagnated between the edge of the insulating film and the electrode, on the downstream side in the direction of flow, and the discharge port.

In the liquid discharging apparatus of the present invention, the electric potential control mechanism may control the electric potential of the electrode by switching the electric potential to the first electric potential and a second electric potential. The first electric potential may be an electric potential which sets the liquid repellence of the insulating film such that the liquid is prevented from being discharged from the discharge port by forming a meniscus of the liquid at a boundary between the insulating film and the adjacent area. The second electric potential may be an electric potential which lowers the liquid repellence of the insulating film such that the liquid is discharged from the discharge port without forming the meniscus of the liquid, at the boundary between the insulating film and the adjacent area. In this case, by switching the electric potential of the electrode to the first electric potential and the second electric potential, the amount and the speed of the liquid discharged can be controlled easily.

In the liquid discharging apparatus of the present invention, the liquid channel may include a plurality of individual liquid channels formed at intervals. In this case, by using the individual liquid channels, a large amount of liquid can be discharged at a time.

In the liquid discharging apparatus of the present invention, a cross-sectional area of the liquid channel may be decreasing toward the discharge port. Accordingly, when the electric potential is let to be the second electric potential, it is possible to stabilize a position of liquid discharged from the discharge port.

In the liquid discharging apparatus of the present invention, the liquid channel may include a uniform area having a uniform cross sectional area along the direction of the flow, and a reduction area having a cross-sectional area reducing gradually toward the discharge port, and the insulating film may be formed in the reduction area. Accordingly, when the electric potential is let to be the second electric potential, it is possible to stabilize the position of the liquid discharged from the discharge port, while suppressing a conductance of the liquid channel.

In the liquid discharging apparatus of the present invention, a width of the liquid channel in a direction orthogonal to the direction of flow may be narrow at the boundary between the insulating film and the adjacent area. Accordingly, since the cross-sectional area of the liquid channel at the boundary between the insulating film and the adjacent area is decreased, when the electric potential is let to be the first electric potential, since the meniscus of the liquid is formed easily at the boundary between the insulating film and the adjacent area, it is possible to stop assuredly the discharge of liquid from the discharge port.

In the liquid discharging apparatus of the present invention, the directional orthogonal to the direction of the flow may be a direction parallel to a direction of a plane of the predetermined surface on which the insulating film is formed. Accordingly, it is possible to cope with a liquid channel without a lid.

In the liquid discharging apparatus of the present invention, the liquid channel may be formed by a substrate in a form of a plate, and a cover member in which a recess is formed. The predetermined surface of the liquid channel may be formed in the substrate, and a surface of the liquid channel excluding the predetermined surface may be formed in the recess in the cover member. Accordingly, on the substrate in the form of a plate, the electrode and the insulating film can be formed easily on a predetermined surface which is divided.

In the liquid discharging apparatus of the present invention, the liquid channel may include a plurality of individual liquid channels which are formed to be adjacent to each other and with a gap, and a highly liquid repellent area having a liquid repellence higher than the liquid repellence of the insulating film and the adjacent area may be formed in the gap between the adjacent individual liquid channels, and each of the individual liquid channels may be defined by the highly liquid repellent area. Accordingly, since it is possible to form the liquid channel easily, it is possible to provide at low cost the liquid discharging apparatus having a simple structure and a high degree of integration.

The liquid discharging apparatus of the present invention, may further include a ground (earth) electrode which is grounded all the time, and which is in contact with the liquid. Accordingly, since the liquid is grounded all the time, when the electric potential is let to be the second electric potential, the electric potential difference between the liquid and the electrode is increased and it is possible to cause the liquid repellence of the insulating member to be lowered assuredly.

The liquid discharging apparatus of the present invention, may further include a pressurizing mechanism which applies pressure to the liquid so that the liquid flows toward the discharge port. Accordingly, when the electric potential of the electrode is let to be the second electric potential, the liquid is discharged assuredly from the discharge port.

In the liquid discharging apparatus of the present invention, each of the individual liquid channels may include an individual discharge port, and the individual discharge channel may is arranged such that the individual discharge ports are arranged in a row, and the liquid channel may further include a common channel which is connected to the individual liquid channels. Accordingly, it is possible to discharge the liquid from a desired individual discharge port by controlling the electric potential of the electrode.

In the liquid discharging apparatus of the present invention, the liquid having the electroconductivity may be ink, and the liquid discharging apparatus may be an ink head. In this case, the liquid discharging apparatus of the present invention can be used as the ink head which discharges ink.

DETAILED DESCRIPTION OF THE PREFERRED EMBODIMENTS

Exemplary embodiments of the present invention will be described below while referring to the accompanying diagrams.

First Embodiment

Figure 1:
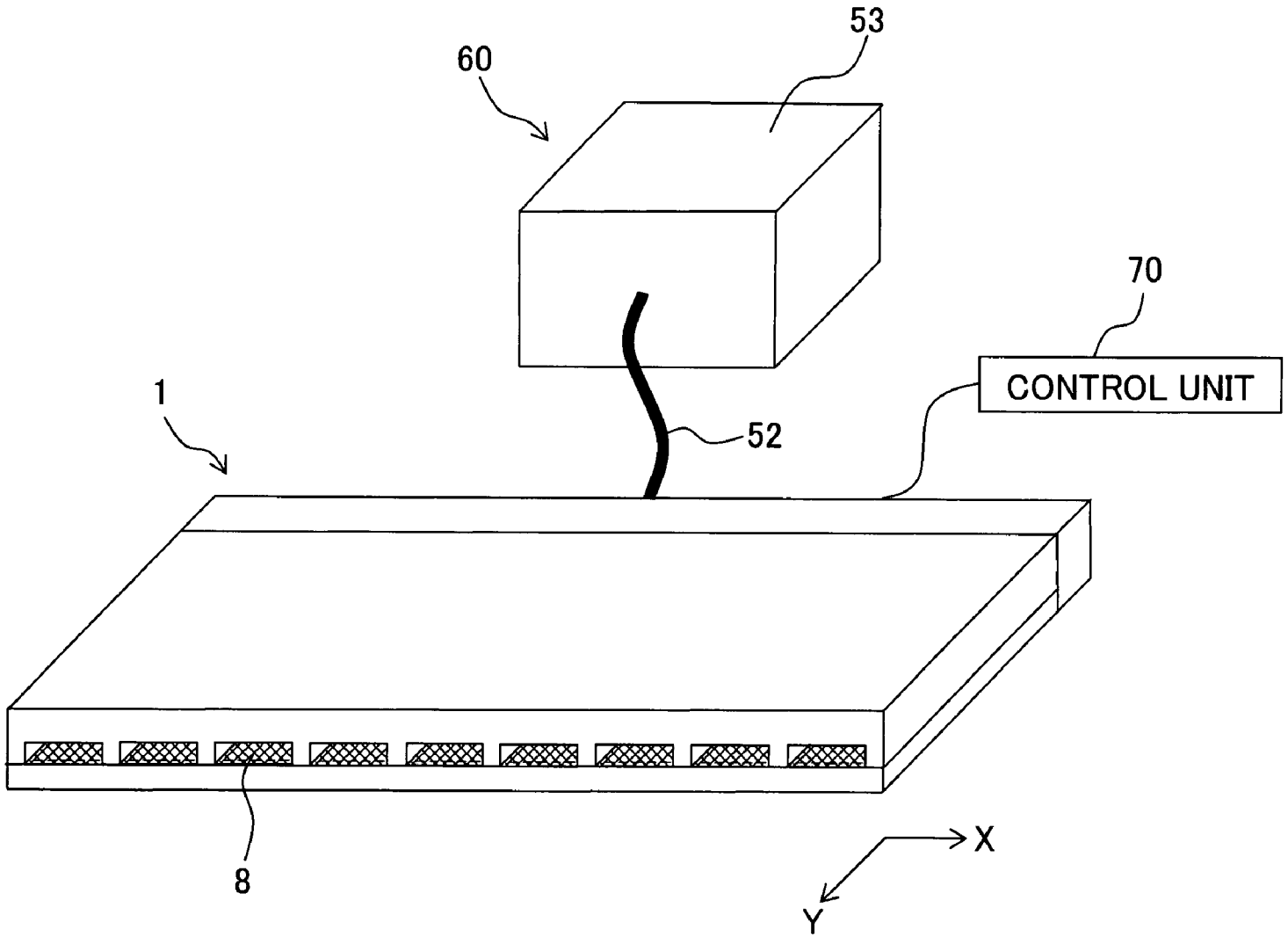
FIG. 1 is a schematic structural diagram of a printer according to a first embodiment of the present invention.

A first embodiment of the present invention is an example in which the present invention is applied to a printer (liquid discharging apparatus) which forms a desired image and/or characters (hereinafter, mentioned as image) on a recording medium by discharging an ink. FIG. 1 is a schematic structural diagram of a printer. As shown in FIG. 1, a printer 60 includes an ink cartridge 53 which stores an electroconductive ink (liquid), and supplies the stored ink to a head 1, the head 1 which prints (an image) by discharging the ink on to a printing paper P (refer to FIG. 6), and a control unit 70 (refer to FIG. 5) which controls various operations of the printer 60 such as an operation of transporting the printing paper P by a paper feeding mechanism which is not shown in the diagram, and a printing operation of the head 1. The ink cartridge 53 and the head 1 are connected by an ink supply tube 52. The ink cartridge 53 is arranged such that there occurs to be a difference in a height of a level of the ink stored in the ink cartridge 53 and a height of the ink in the head 1, in other words the ink cartridge 53 is arranged such that there occurs to be a water head difference (pressurizing mechanism). Due to the water head difference, the ink stored in the ink cartridge 53 is pressurized, and supplied to the head 1 via the ink supply tube 52.

Figure 2:
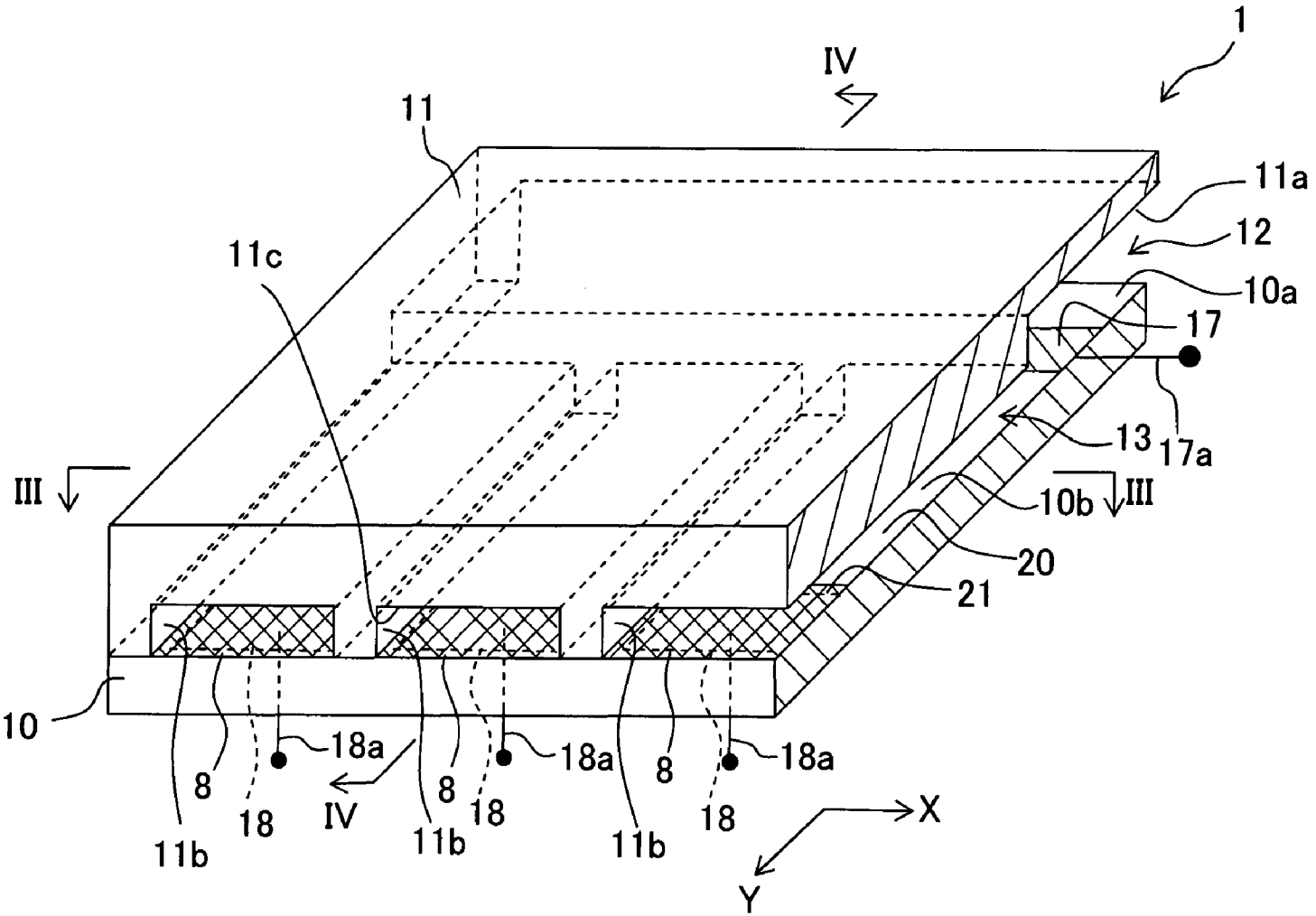
FIG. 2 is a perspective view of a head shown in FIG. 1.
Figure 3:
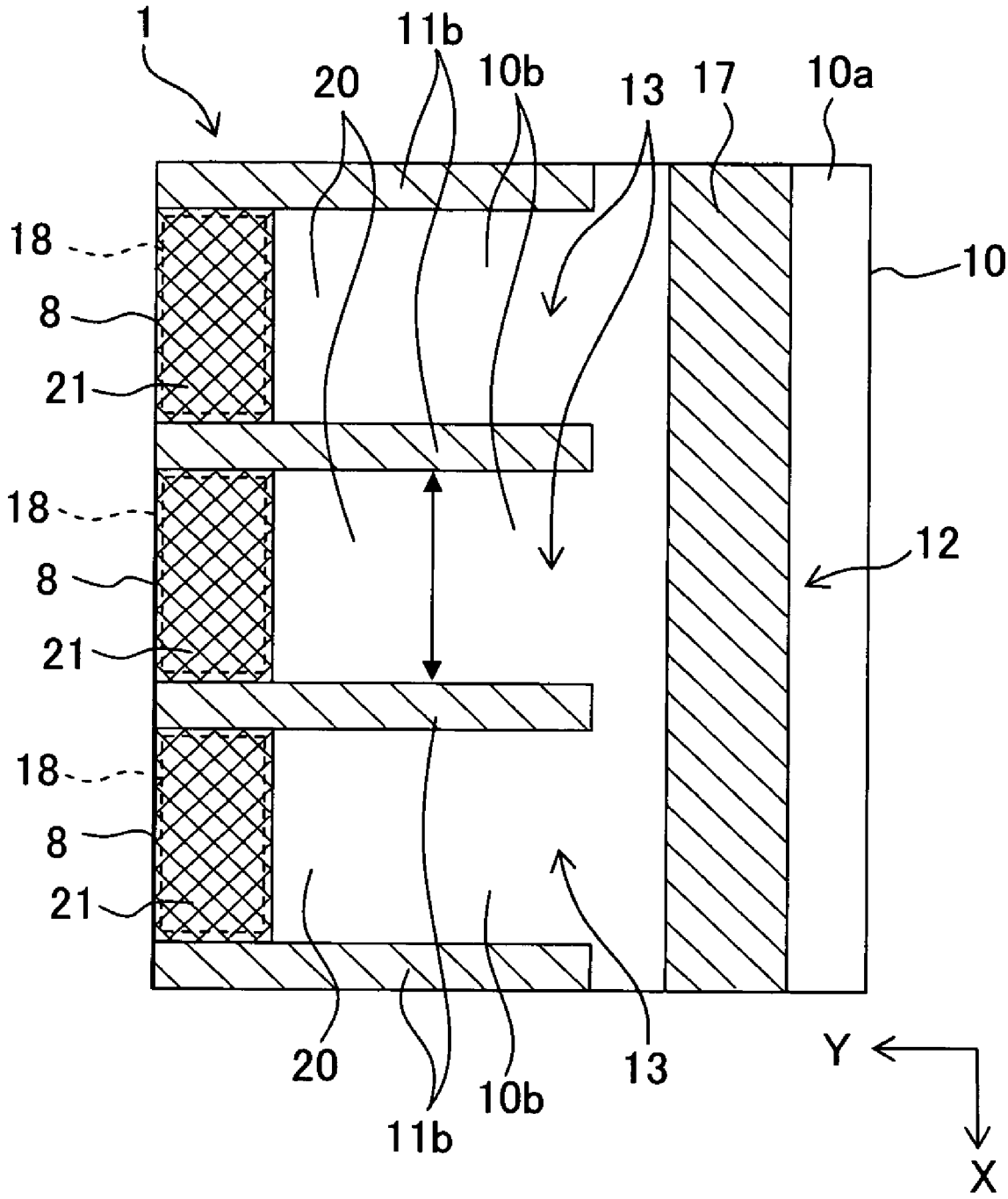
FIG. 3 is a horizontal cross-sectional view of the head taken along a line III-III shown in FIG. 2.
Figure 4:
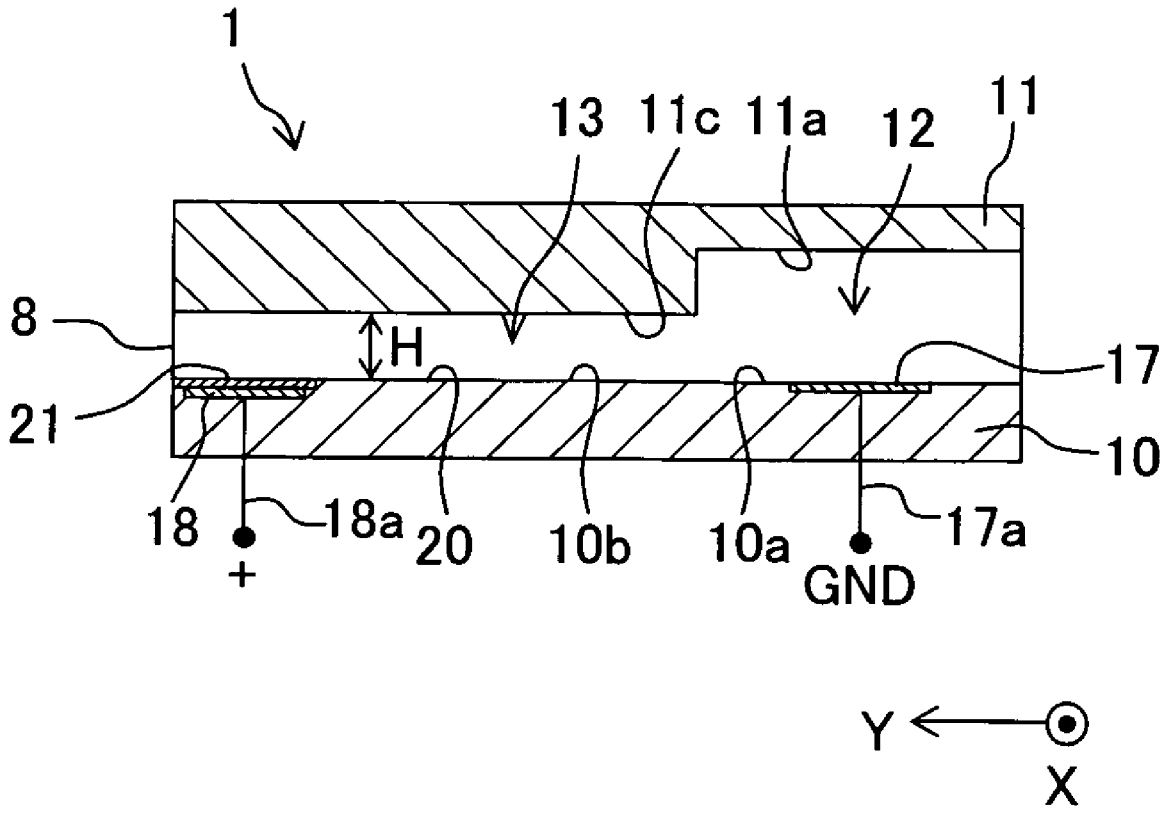
FIG. 4 is a vertical cross-sectional view of the head taken along a line IV-IV shown in FIG. 2.

Next, the head 1 will be described in detail while referring to FIG. 2 to FIG. 4. FIG. 2 is a partial perspective view of the head 1 shown in FIG. 1. FIG. 3 is a horizontal cross-sectional view of the head 1 taken along a line III-III shown in FIG. 2. FIG. 4 is a vertical cross-sectional view of the head 1 taken along a line IV-IV shown in FIG. 2. In FIG. 2 to FIG. 4, a longitudinal direction of the head 1 is an X direction, and a width direction of the head 1 is a Y direction. As shown in FIG. 2 to FIG. 4, the head 1 includes a cover member 11 and a substrate 10 in a form of a rectangular shaped plate, and the substrate 10 and the cover member 11 are joined facing mutually. Each of the substrate 10 and the cover member 11 is made of a material such as a glass material, polyimide, or silicon on a surface of which $SiO_2$ is formed, and is non-conductive (and has an insulating property) at least with respect to a surface on which each electrode which will be described later is formed, and a surface which comes in contact with the ink.

A common channel defining surface 10*a* extending in the X direction is formed at one of end portions in the Y direction (right-half portion in FIG. 3 and FIG. 4) of a surface of the substrate 10. Moreover, a plurality of ink channel defining surfaces (predetermined inner surfaces) 10*b* extending in the Y direction is formed at intervals at the other end portion in the Y direction (left-half portion in FIG. 3 and FIG. 4) of the surface of the substrate 10. On the other hand, a groove 11*a* extending in the X direction is formed in one of end portions in the Y direction (right-half portion in FIG. 3 and FIG. 4) of the cover member 11. Moreover, a plurality of partition walls 11*b* extending in the Y direction is formed at the other end portion in the Y direction (left-half portion in FIG. 3 and FIG. 4) of the cover member 11, and between the partition walls 11*b*, a groove 11*c* which communicates with the groove 11*a* is formed. A common channel 12 extending in the X direction is formed by the common channel defining surface 10*a* of the substrate 10, and the groove 11*a* of the cover member 11, and further, a plurality of ink channels (individual ink channels) 13 extending in the Y direction and each branched from the common channel 12, is formed by the ink channel defining surfaces 10*b* of the substrate 10, and the grooves 11*c* of the cover member 11. Each ink channel 13 has a rectangular cross-sectional shape, and in the first embodiment, a width B of the ink channel 13 is about 70 μm and a height of the ink channel 13 is about 20 μm. Although only three ink channels 13 are shown in FIG. 2 and FIG. 3, in reality, more than four ink channels 13 are arranged at equal intervals in the X direction.

A discharge port 8 from which the ink is discharged is formed at a front end of each ink channel 13, and the plurality of discharge ports 8 is arranged in a row along the X direction. Moreover, ink flowed into the head 1 from the ink cartridge 53 is supplied to each of the ink channels 13 from the common channel 12 due to being pressurized. Furthermore, in each ink channel 13, the ink is flowed in a direction from the common channel 12 toward the discharge port 8 (direction of flow of liquid: hereinafter, "direction of ink-flow"). Then, the ink is discharged on to the printing paper P from the discharge ports 8 of the ink channels 13 (refer to FIG. 8). The printing paper P is sent to a Z-axis direction (vertical direction) in a forward direction in FIG. 2 by a paper feeding mechanism which is not shown in the diagram.

On the ink channel defining surface 10*b* of each ink channel 13, an insulating film 21 (hatched area in the form of a mesh in FIG. 2 and FIG. 3) extending toward an upstream side in the direction of ink flow from the discharge port 8, and an adjacent area 20 which is an area having a liquid repellence lower than the liquid repellence of the insulating film 21, and which is adjacent to the insulating film 21, at an upstream side in the direction of ink flow, are formed. The insulating film 21 is formed to occupy an entire area in a direction of width(X direction) of the ink channel defining surface 10*b*, and has a substantially rectangular shape in a plan view. Moreover, as shown in the diagram, an edge of a downstream side in the direction of ink flow, of the insulating film, is extended in a direction orthogonal to the direction of ink flow, and forms (defines) the discharge port 8. In other words, the insulating film 21 is extended up to the substantially same position as a position of the discharge port 8 in the direction of ink flow, in the ink channel defining surface 10*b*. A control electrode 18 which will be described later is coated with the insulating film 21. The insulating film 21 can be formed by coating a fluororesin on a surface of the control electrode 13 and the ink channel defining surface 10*b* of the ink channel 13 by a method such as a spin coating method. In the first embodiment, a film thickness of the insulating film is about 0.1 μm. Moreover, the insulating film 21 is not formed in the adjacent area 20, and the adjacent area 20 is formed by a surface of the substrate 10.

As shown mainly in FIG. 4, the control electrode 18 having a wire 18*a* is provided between the insulating film 21 and the substrate 10. The control electrode 18 is formed to have a shape similar to a shape of the insulating film 21 and a size slightly smaller than the insulating film 21. The control electrode 18 is extended toward the upstream side in the direction of ink flow, from an area around the discharge port 8, in a lower layer of the insulating film 21. In other words, the control electrode 18 is formed to occupy an entire area in the direction of width of the ink channel defining surface 10*b*, in a plan view, and formed in the substantially same shape as the insulating film 21. Moreover, the control electrode 18 is electrically connected to the control unit 70 (refer to FIG. 1) via the wire 18*a*. The plurality of control electrodes 18 can be formed on the surface of the substrate 10 by a known method such as a vapor deposition method, a sputtering method, or a printing method, and furthermore, the control electrodes 18 can be formed at the same time. Accordingly, it is possible to form easily the control electrodes 18.

An earth (ground) electrode 17 having a wire 17*a* and extending in the X direction is provided on the common channel defining surface 10*a* of the common channel 12. The earth electrode 17 is grounded (connected to earth) all the time via the wire (portion) 17*a*. Consequently, the electroconductive ink in the head 1 is in contact with the earth electrode 17, and is kept at a ground potential all the time. Similarly as the control electrode 18, the earth electrode 17 also can be formed on the surface of the substrate 10 by a known method such as the vapor deposition method, the sputtering method, or the printing method.

Figure 5:
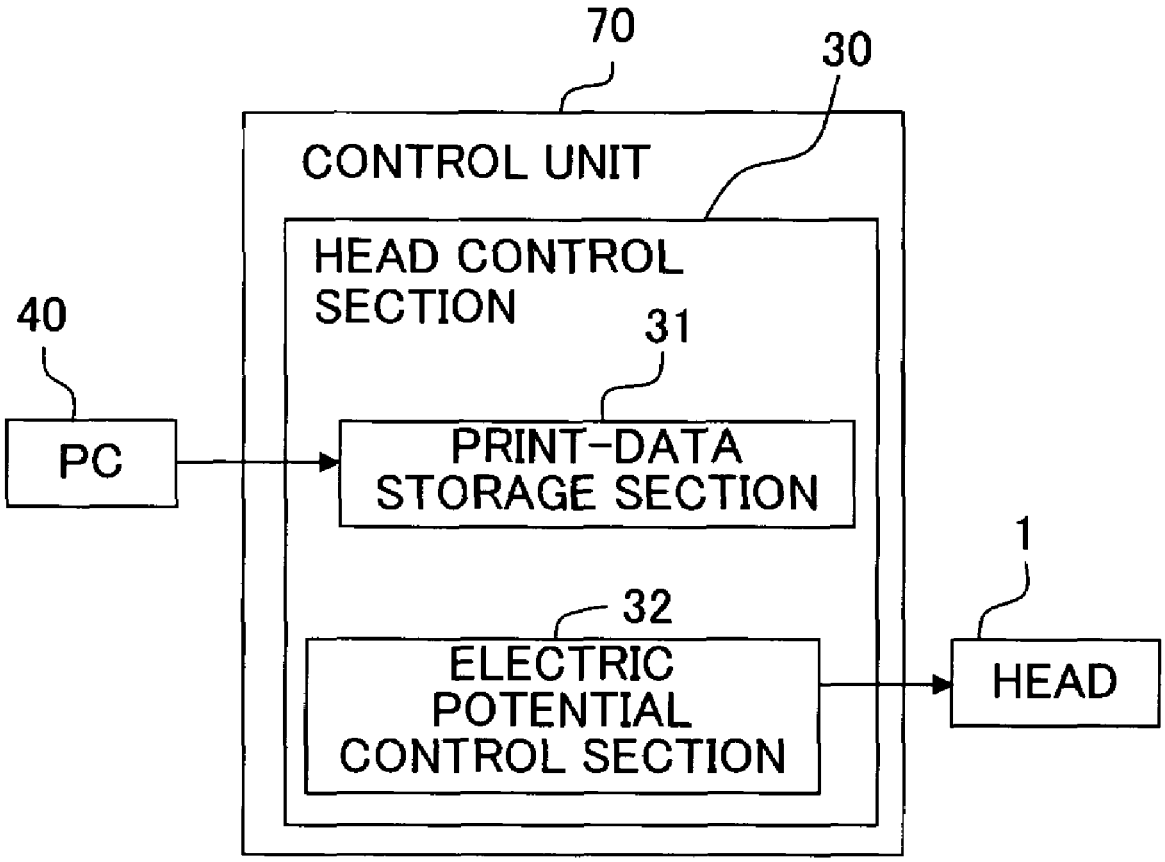
FIG. 5 is diagram showing an electrical structure of the printer shown in FIG. 1.

Next, an electrical structure of the printer 60 of the first embodiment will be described while referring to FIG. 5. FIG. 5 is a diagram showing the electrical structure of the printer 60. The control unit 70 includes a CPU (Central Processing Unit), a ROM (Read Only Memory) in which various computer programs and data which control an entire operation of the printer 60 are stored, and a RAM (Random Access Memory) which stores temporarily data etc. to be processed by the CPU, and realizes each of the following functions by a combined action of the CPU, the ROM, and the ROM.

In other words, the control unit 70 transports the printing paper P by controlling a paper feeding mechanism which is not shown in the diagram. Moreover, the control unit 70 includes a head control section 30 which controls an operation of printing on the printing paper P by the head 1. The head control section 30 controls individually as to whether or not to discharge the ink from the discharge port 8 of each ink channel 13, by controlling an electric potential of the control electrode 18.

As shown in FIG. 5, the head control section 30 includes a print-data storage section 31 which stores print data which is input from a personal computer (PC) 40, and an electric potential control section 32 which controls to switch the electric potential of the control electrode 18 either to the ground electric potential (first electric potential) or to a predetermined electric potential (second electric potential), based on the print data stored in the print-data storage section 31. Here, when the control electrode 18 is set to be at the first electric potential, a pressure applied to the ink and the liquid repellence of the insulating film 21, are adjusted such that a meniscus is formed at a boundary between the insulating film 21 and the adjacent area 20. Moreover, when the control electrode 18 is set to be at the second electric potential, the pressure applied to the ink and the liquid repellence of the insulating film 21 are adjusted such that the meniscus formed at the boundary between the insulating film 21 and the adjacent area 20 is destroyed. As it will be described later, by changing the electric potential of the control electrode 18 by the electric potential control section 32, the liquid repellence of the surface of the insulating film 21 covering the control electrode 18, with respect to the ink is changed (electrowetting phenomenon). Accordingly, a control of as to whether or not to discharge the ink from the discharge port 8 is made.

Figure 6:
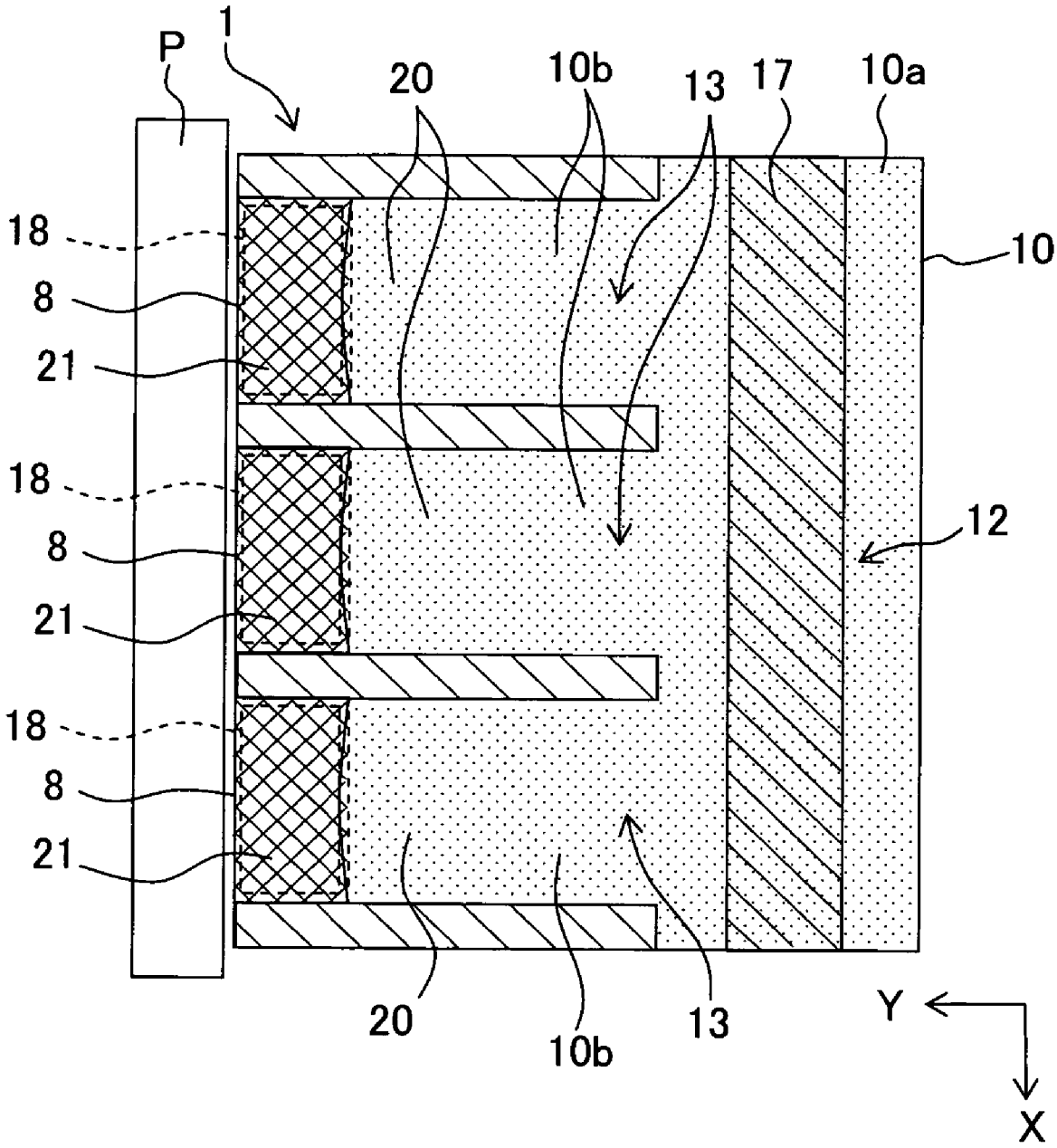
FIG. 6 is a horizontal cross-sectional view of a head 1 showing a condition when ink is not discharged from a discharge port of the head shown in FIG. 1.
Figure 7:
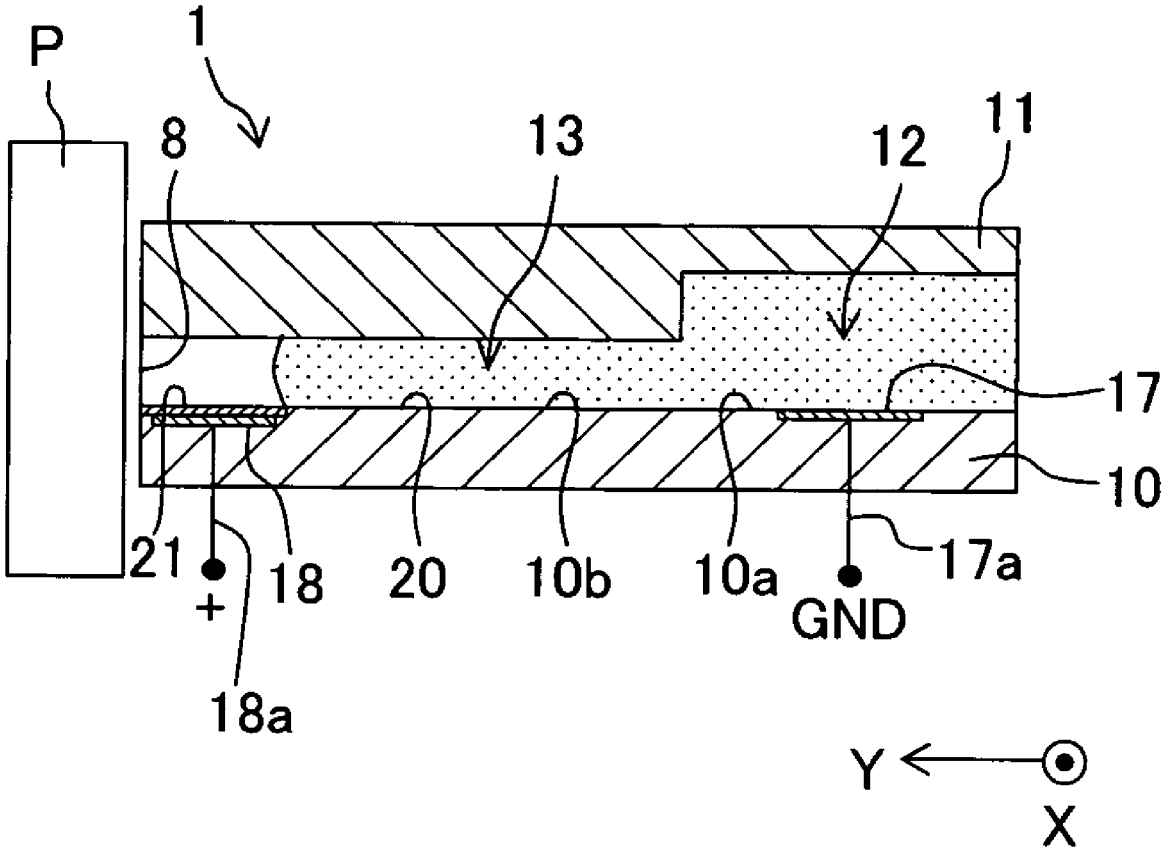
FIG. 7 is a vertical cross-sectional view of the head 1 showing the condition when ink is not discharged from the discharge port of the head shown in FIG. 1.
Figure 8:
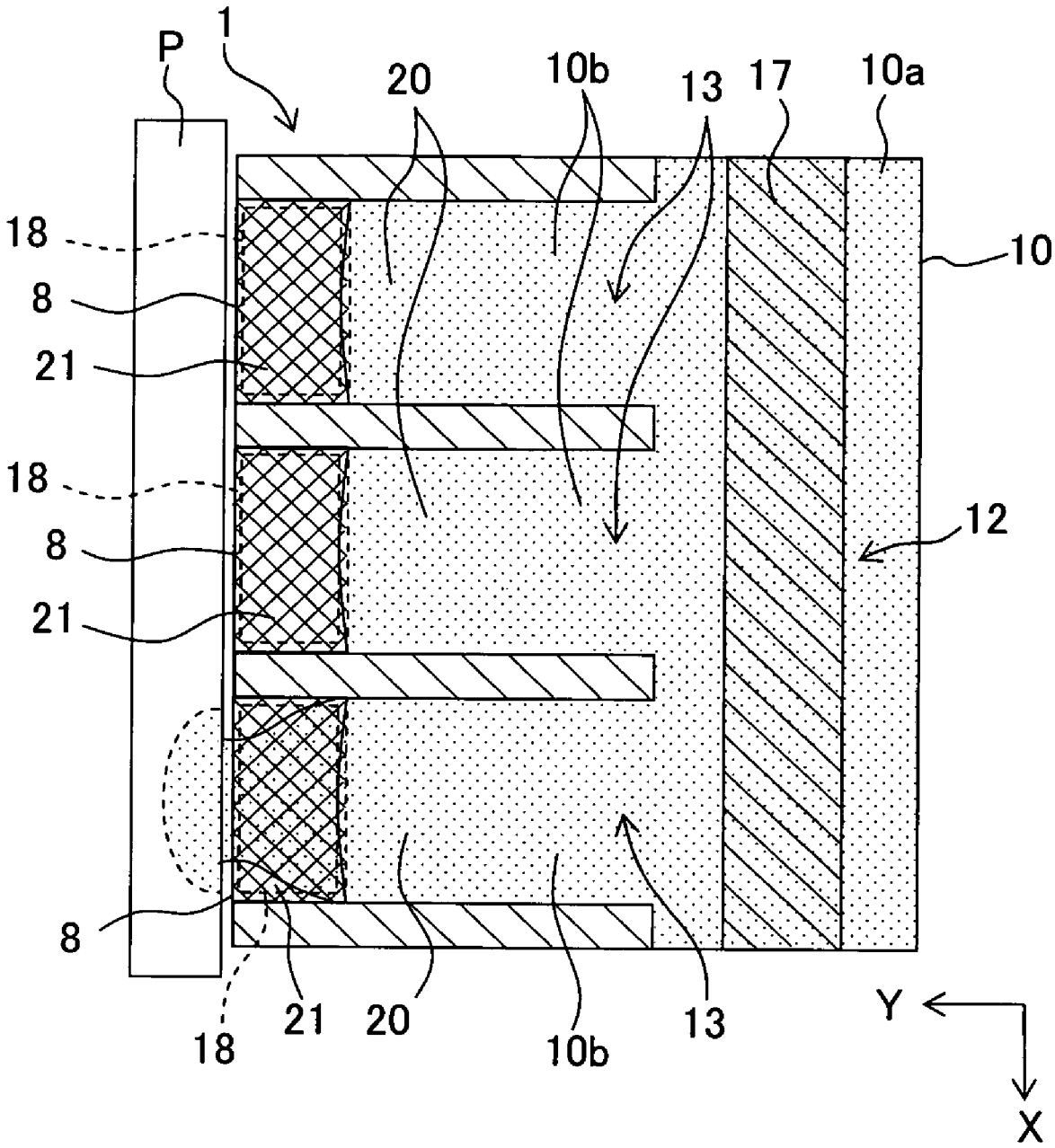
FIG. 8 is a horizontal cross-sectional view of the head 1 showing a condition when ink is discharged from the discharge port of the head shown in FIG. 1.
Figure 9:
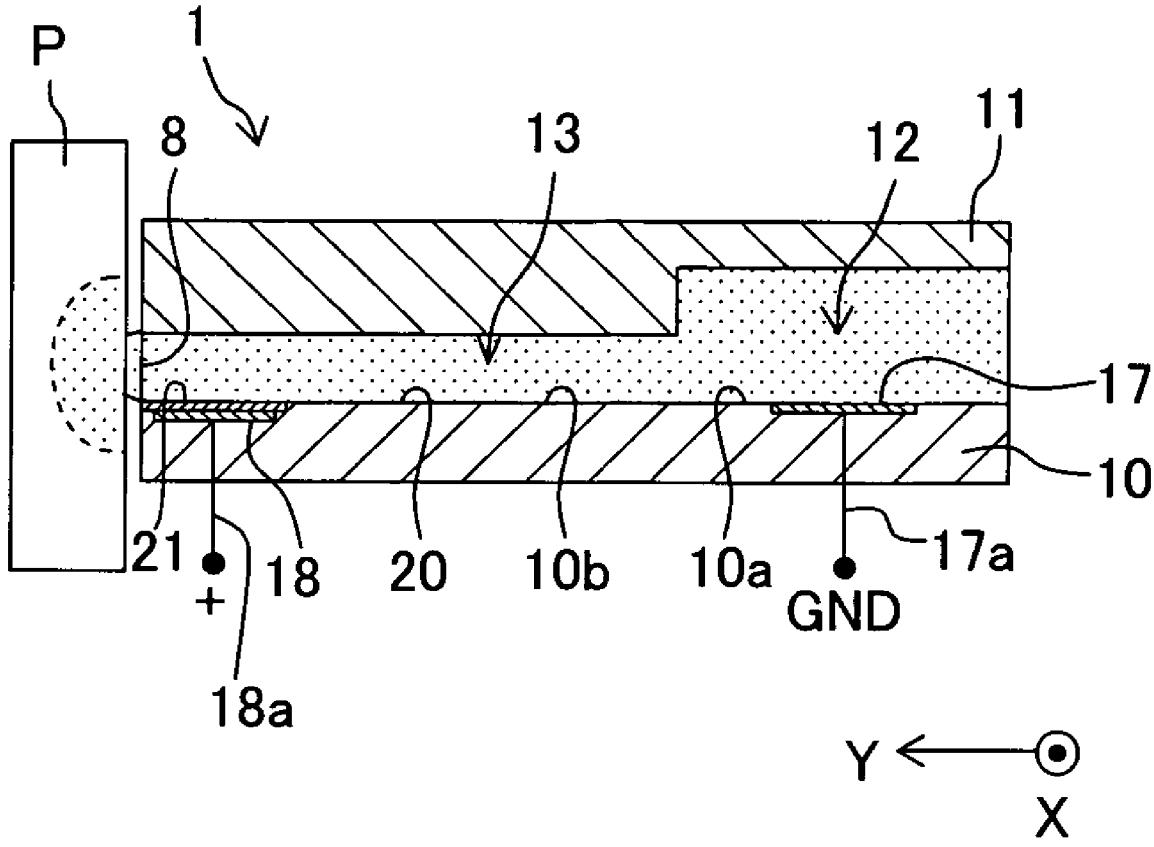
FIG. 9 is a vertical cross-sectional view of the head 1 showing the condition when ink is discharged from the discharge port of the head shown in FIG. 1.

Next, an operation of the ink head 1 will be described while referring to FIG. 6 to FIG. 9. FIG. 6 is a horizontal cross-sectional view of the head 1 showing a condition when the ink is not discharged from the discharge port 8, and FIG. 7 is a vertical cross-sectional view of the head 1 showing the condition when the ink is not discharged from the ink discharge port 8. FIG. 8 is a horizontal cross-sectional view of the head 1 showing a condition when the ink is discharged from the discharge port 8, and FIG. 9 is a vertical cross-sectional view of the head 1 showing the condition when the ink is discharged form the discharge port 8. When the ink is not made to be discharged from the discharge port 8, the electric potential control section 32 lets the electric potential of the control electrode 18 to be the ground electric potential. When the electric potential of the control electrode 18 is the ground electric potential, since the ink is kept at the ground electric potential by the earth electrode 17, there is no electric potential difference between the ink and the control electrode 18. When there is no electric potential difference between the ink and the control electrode 18, the insulating film 21 is still in a state of having a strong liquid repellence with respect to the ink, as it has been. When the insulating film is in the state of having the strong liquid repellence with respect to the ink, as shown in FIG. 6 and FIG. 7, the ink cannot move on the surface of the insulating film 21, and a meniscus of ink is formed at the boundary between the insulating film 21 and the adjacent area 20. Accordingly, the ink is not discharged from the discharge port 8.

Moreover, at the time of making the ink discharge from the discharge port 8, the electric potential control section 32 lets the electric potential of the control electrode 18 to be the predetermined electric potential. When the electric potential of the control electrode 18 is let to be the predetermined electric potential, the electric potential difference between the ink which is grounded (connected to earth) and the control electrode 18 is increased, and the control electrode 18, and the liquid repellence of the surface of the insulating film 21 with respect to the ink becomes weak. In other words, the wetting angle of the ink with respect to the surface of the insulating film 21 is decreased. Thus, a phenomenon of weakening of the liquid repellence of surface of an insulating film with respect to an electroconductive liquid when a voltage is applied between an electrode arranged sandwiching the insulating film, and the electroconductive liquid is called as the electrowetting phenomenon. Due to the electrowetting phenomenon, when the control electrode 18 is at the predetermined electric potential, the liquid repellence of the insulating film 21 is lowered (becomes inferior) as compared to the liquid repellence when the control electrode 18 is at the ground electric potential. Therefore, as shown in FIG. 8 and FIG. 9, the meniscus of the ink at the boundary between the insulating film 21 and the adjacent area 20 is destroyed, and the ink is moved to the surface of the insulating film 21. The ink moved to the surface of the insulating film 21 is discharged from the discharge port 8. The ink discharged from the discharge port 8 is reached to the printing paper P. The predetermined electric potential may be a positive electric potential or a negative electric potential with respect to the ground electric potential.

Thus the ink can be made to be discharged from a desired discharge port 8 by controlling individually the electric potential of each control electrode 18 by the electric potential control section 32.

According to the printer 60 described above, it is possible to control as to whether or not to discharge the ink from the discharge port 8 by adjusting the electric potential of the control electrode, by using the electrowetting effect. Consequently, it is possible to have the head 1 having a simple structure and a high degree of integration at a low cost. Moreover, since an energy required for discharging the ink from the discharge port 8 is low, it is possible to reduce the size and cost of electric components.

Moreover, the partition walls 11*b*, the grooves 11*c*, and the groove 11*a* for dividing the common channel 12 and the ink channel 13, are formed in the cover member 11. On the other hand, since the surface of the substrate 10 is flat, the control electrode 18 and the insulating film 21 can be formed easily on one of the surfaces of the substrate 10 in the form of a rectangular plate.

Furthermore, since the electroconductive ink is in contact with the earth electrode 17, and is kept and the ground electric potential, by letting the control electrode 18 to be at the predetermined electric potential, it is possible to generate assuredly the electric potential difference between the ink and the control electrode 18, and to decline assuredly the liquid repellence of the insulating film 21.

As described earlier, since the ink cartridge 53 is installed such that there occurs to be a water head difference between the ink stored in the ink cartridge 53 and the ink in the head 1, the ink stored in the ink cartridge 53 is pressurized. Accordingly, the ink is pressurized along the direction of ink flow in the ink channel 13, and the ink is discharged assuredly from the discharge port 8.

First Modified Embodiment

Figure 10:
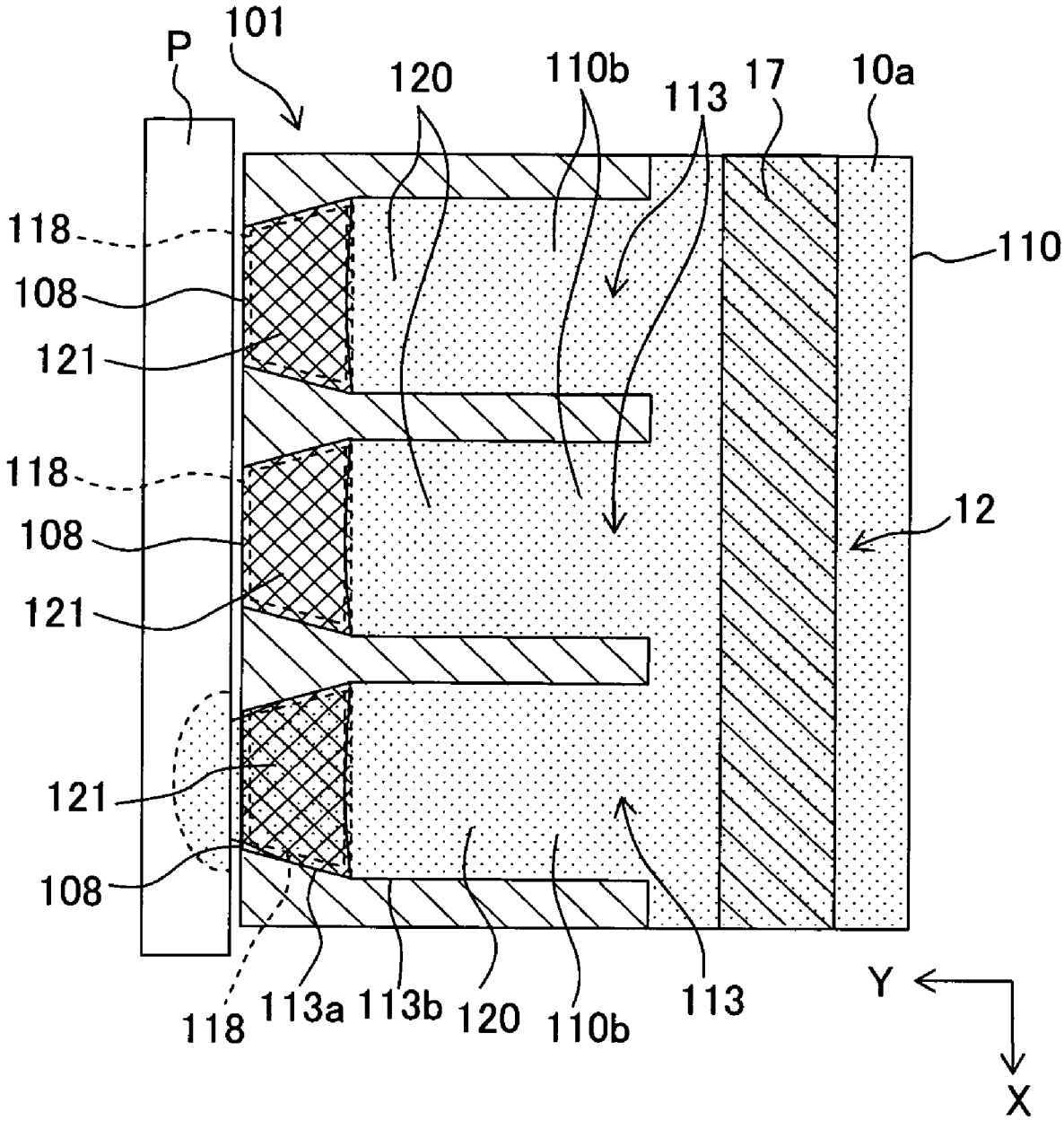
FIG. 10 is a horizontal cross-sectional view showing a first modified embodiment of the head shown in FIG. 1.
Figure 11:
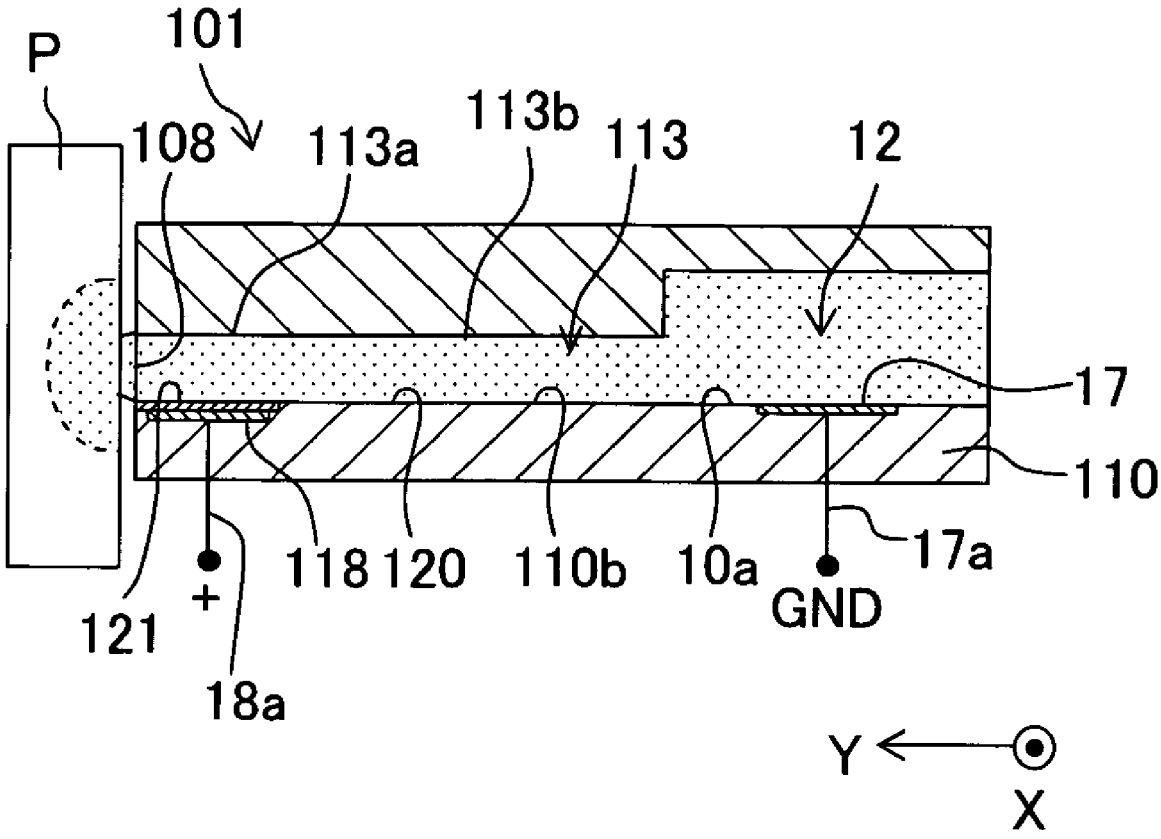
FIG. 11 is a vertical cross-sectional view showing the first modified embodiment of the head shown in FIG. 1.

Next, a first modified embodiment of the first embodiment will be described while referring to FIG. 10 and FIG. 11. FIG. 10 is a horizontal cross-sectional view of a head according to the first modified embodiment. FIG. 11 is a vertical cross-sectional view of the head. As shown in FIG. 10 and FIG. 11, a head 101 includes a plurality of ink channels 113 extending in the Y direction and each branched from the common channel 12. Each ink channel 113 has a rectangular cross-sectional shape. On an ink channel defining surface 110*b* of the ink channel 113, an insulating film 121 which is extended from a discharge port 108 toward an upstream side in the direction of ink flow, and which occupies an entire area in a direction of width of the ink channel defining surface 110*b* is formed. A control electrode 118 is formed between the insulating film 121 and a substrate 110. In other words, the insulating film 121 covers the control electrode 118. The control electrode 118 is extended from the discharge port 108 toward the upstream side in the direction of ink flow, on a lower side of the insulating film 121. Moreover, an area in which the insulating film 121 is formed has a trapezoidal shape tapering toward the discharge port 108 in a plan view, and in accordance with the trapezoidal shape of the area, the control electrode 118 and the insulating film 121 also have trapezoidal shape. In other words, the ink channel 113 includes a reduction area (tapered area) 113*a* of which a cross-sectional area is diminished gradually toward the discharge port 108 and a uniform area 113*b* which is positioned between the reduction area 113*a* and the common channel 12, and which has a uniform cross-sectional area in the direction of ink flow.

Thus, since the ink channel 113 includes the reduction area 113*a* and the uniform area 113*b*, it is possible to suppress a conductance in the ink channel 113. Furthermore, since the front end of the ink channel 113 is tapered, when the control electrode 118 is let to be at the predetermined electric potential, a variation in a position of ink discharged from the discharge port 108 can be suppressed to be less.

In the first modified embodiment, the control electrode 118 and the insulating film 121 are arranged in approximately the entire area of the ink channel defining surface 110 related to the reduction area 113*a*. However, the ink channel may be structured such that by extending further the reduction area 113*a* toward the upstream side in the direction of ink flow, the control electrode 118 and the insulating film 121 are arranged on a part of the ink channel defining surface related to the reduction area. Furthermore, the structure may be such that the entire ink channel becomes the reduction area, so that the uniform area is not formed.

Second Modified Embodiment

Figure 12:
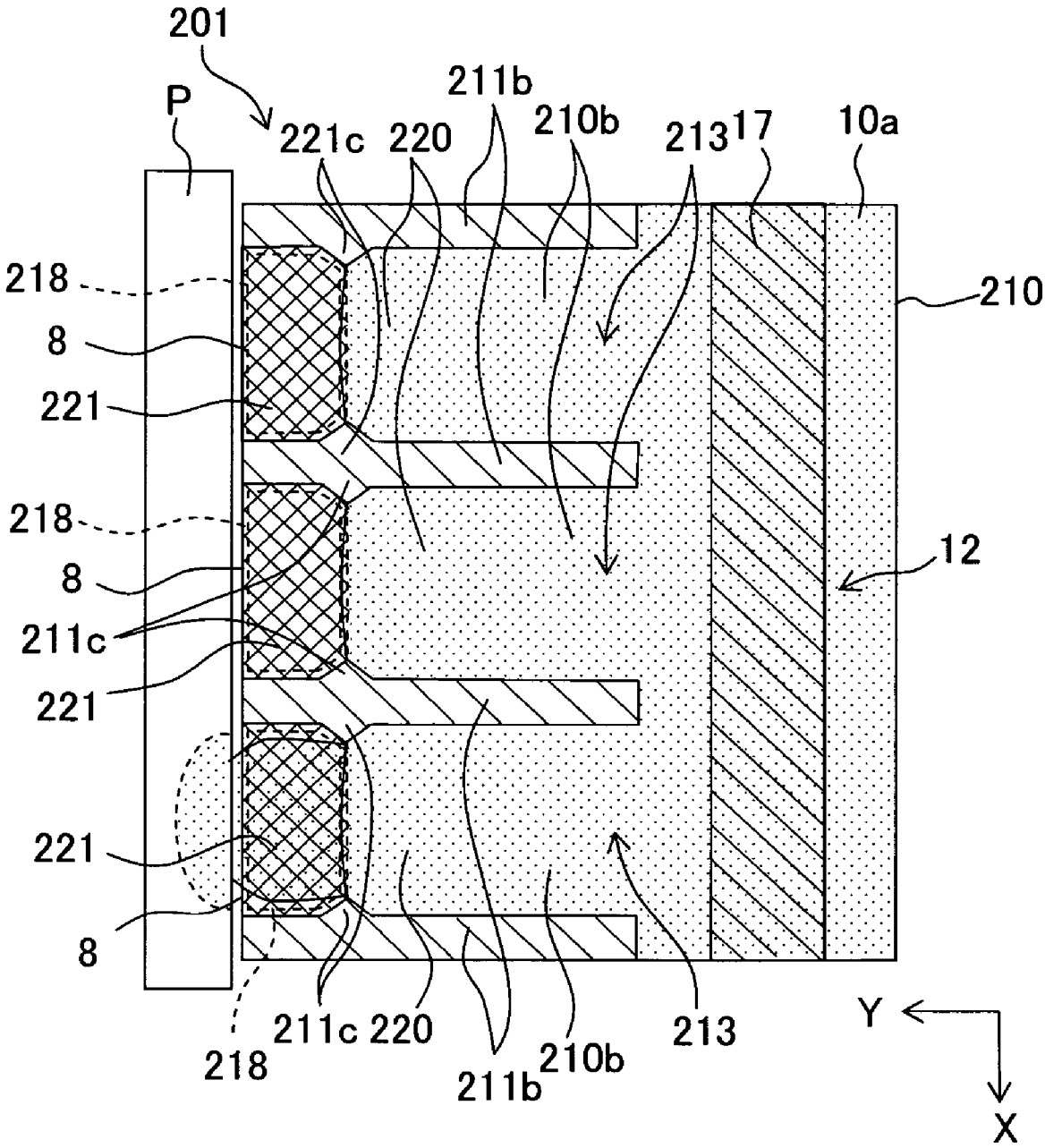
FIG. 12 is a horizontal cross-sectional view showing a second modified embodiment of the head shown in FIG. 1.
Figure 13:
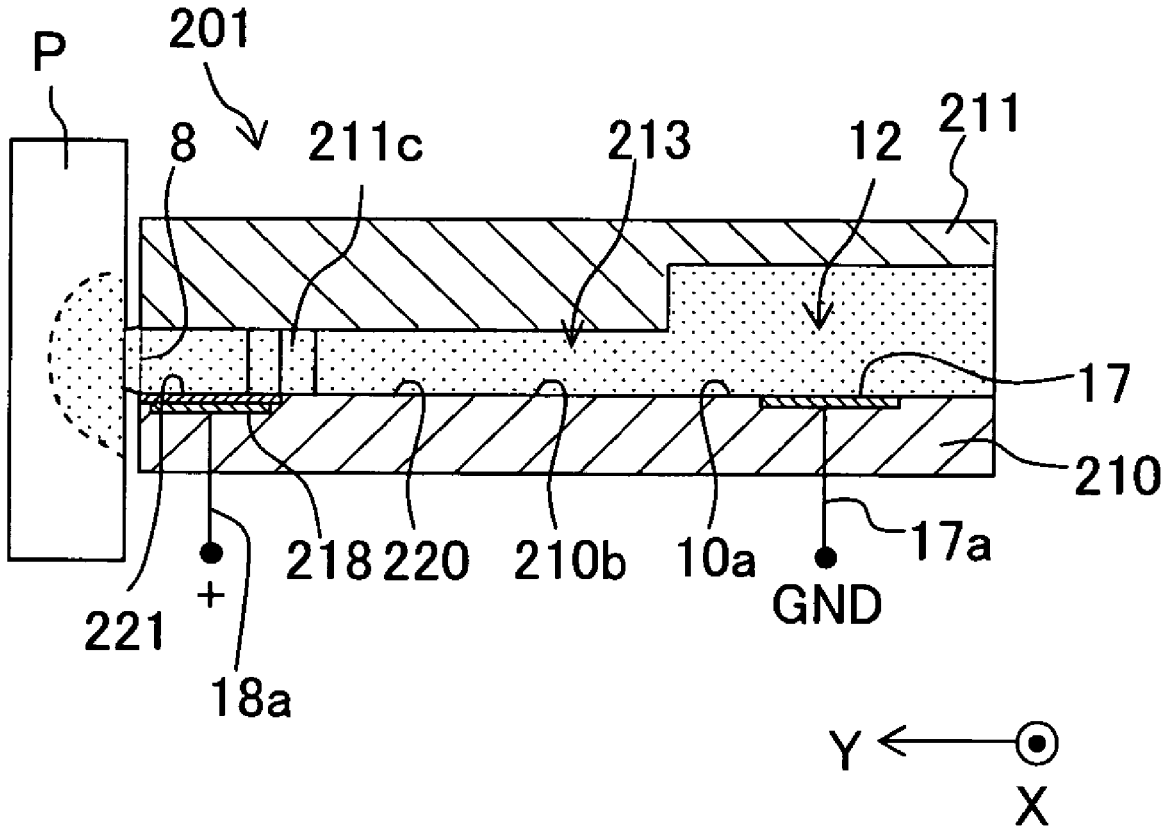
FIG. 13 is a vertical cross-sectional view showing the second modified embodiment of the head shown in FIG. 1.

Next a second modified embodiment of the first embodiment will be described while referring to FIG. 12 and FIG. 13. FIG. 12 is a horizontal cross-sectional view according to the second modified embodiment. FIG. 13 is a vertical cross-sectional view of a head. As shown in FIG. 12 and FIG. 13, a head 201 includes a plurality of ink channels 213 extending in the Y direction and each branched from the common channel 12. Each ink channel 213 has a rectangular cross-sectional shape. On an ink channel defining surface 210*b* forming (defining) the ink channel 213, an insulating film 221 which is extended from the discharge port 8 toward the upstream side in the direction of ink flow, and which is provided along the entire area in a direction of width of the ink channel defining surface 210*b*, and an adjacent area 220 having the liquid repellence lower than a liquid repellence of the insulating film 221, which is adjacent to the upstream side in the direction of ink flow of the insulating film 221 are formed. A control electrode 218 is formed between the insulating film 221 and a substrate 210. In other words, the control electrode 218 is covered by the insulating film 221. Moreover, the control electrode 218 is extended from the discharge port 8 toward the upstream side in the direction of ink flow, on a lower side of the insulating film 221. The control electrode 218 and the insulating film 221 have a rectangular shape in a plan view. Each partition wall 221*b* which divides the ink channel 213 has two projections 211*c* projecting toward each of the two adjacent ink channels 213, at a boundary between the insulating film 221 and the adjacent area 220. In other words, a width of the ink channel 213 in a direction of width of the ink channel defining surface 210*b* (X direction: direction parallel to a surface of the insulating film 221 out of a direction orthogonal to the direction of ink flow) is narrow at the boundary between the insulating film 221 and the adjacent area 220.

Accordingly, since a cross-sectional area of the ink channel 213 at the boundary between the insulating film 221 and the adjacent area 220 is decreased due to the projection 211*c*, when the control electrode 218 is at the predetermined electric potential, the meniscus of ink is formed easily at the boundary between the insulating film 221 and the adjacent area 220. Consequently, the discharge of ink from the ink discharge port 8 can be stopped assuredly. Moreover, since the effect mentioned above does not depend on a shape of a lid (cover member) on the ink channel 213, it can be dealt with even when there is no lid.

In the first embodiment, the cross-sectional area of the ink channel 213 at the boundary between the insulating film 221 and the adjacent area 220 is decreased by narrowing the width of the ink channel 213 in the direction parallel to the surface of the insulating film 221 out of the direction orthogonal to the direction of ink flow. However, a projection projecting toward a lower side at a boundary between an insulating film and an adjacent area may be provided to a lid of the ink channel. Accordingly, the width of the ink channel in a direction perpendicular to the flat surface of the insulating film out of the direction orthogonal to the direction of ink flow is decreased, and the cross-sectional area of the ink channel at the boundary between the insulating film and the adjacent area can be decreased without shortening a length of a portion of the boundary between the insulating film and the adjacent area. Therefore, when the control electrode is let to be at the predetermined potential, the meniscus of ink is formed easily at the boundary between the insulating film and the adjacent area.

Second Embodiment

Figure 14:
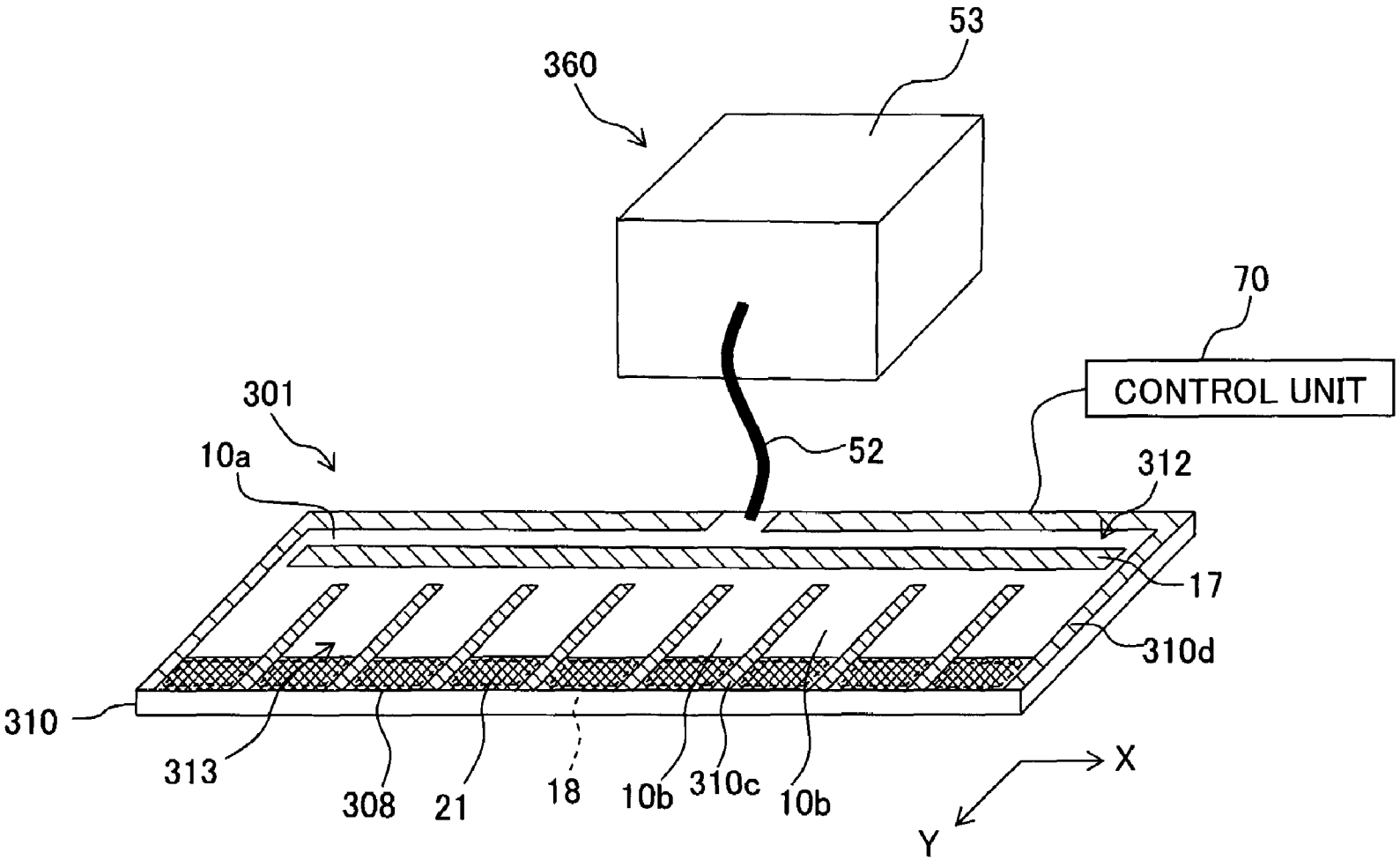
FIG. 14 is schematic structural diagram of a printer according to a second embodiment of the present invention.

Next a second embodiment of the present invention will be described while referring to the diagrams. Same reference numerals are used for members, which are the same as the members in the first embodiment, and the description of such members is omitted. FIG. 14 is a schematic structural diagram of a printer which is the second embodiment according to the present invention. As shown in FIG. 14, a printer 360 includes the ink cartridge 53, a head 301 which is substantially rectangular in shape that is long in one direction, and which prints by discharging ink on to the printing paper P, and the control unit 70. The ink cartridge 53 and the head 301 are connected by the ink supply tube 52. The ink cartridge 53 is arranged such that there occurs to be a water head difference between the ink stored in the ink cartridge 53 and the ink in the head 301 (pressurizing mechanism). Due to the water head difference, the ink stored in the ink cartridge 53 is pressurized, and is supplied to the head 301 via the ink supply tube 52.

Figure 15:
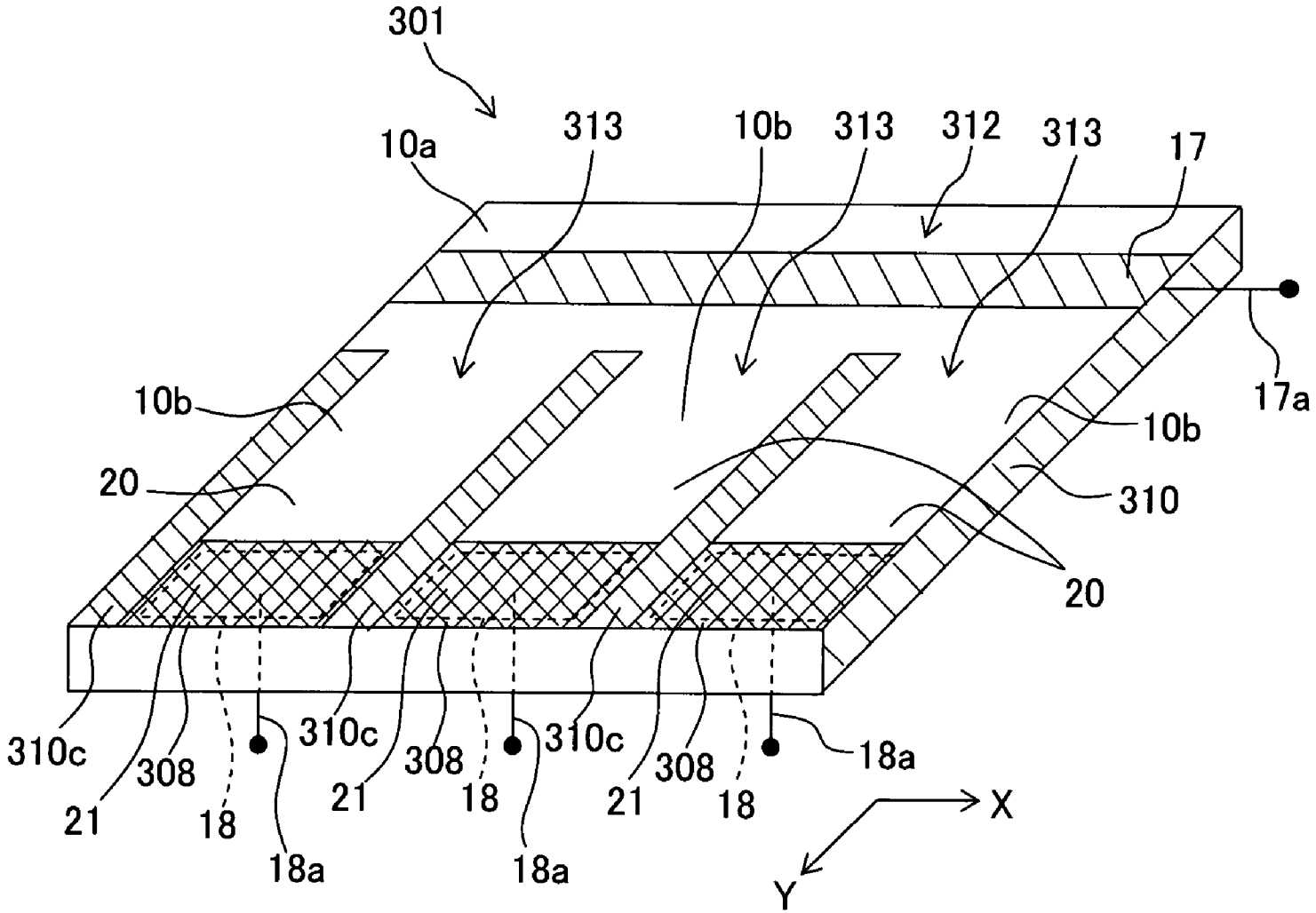
FIG. 15 is a perspective view of a head shown in FIG. 14.

Next, the head 301 will be described in detail while referring to FIG. 15. FIG. 15 is a perspective view of the head 301 shown in FIG. 14. In FIG. 15, a longitudinal direction of the head 301 determines an X direction and a width direction of the head 301 determines a Y direction. As shown in FIG. 15, the head 301 includes a substrate 310 in the form of a rectangular shaped plate, and a plurality of ink channels is formed on the substrate 310. The substrate 310 is made of a material such as a glass material, polyimide, or silicon on a surface of which $SiO_2$ is formed, and has an insulating property at least on a surface on which each of individual electrodes which will be described later is formed, and on a surface which comes in contact with the ink.

The common channel defining surface 10*a* extending in the X direction is formed at one of end portions in the Y direction of a surface of the substrate 310. Moreover, the plurality of ink channel defining surfaces (predetermined inner surfaces) 10*b*extending in the Y direction is formed at intervals at the other end portion in the Y direction of the surface of the substrate 310. Furthermore, a highly liquid repellent area 310*c* is formed on the surface of the substrate 310 between the ink channel defining surfaces 10*b*. Moreover, a highly liquid repellent area 310*d* is formed at an edge portion of the substrate 310, excluding a portion of the other end portion in the Y direction. The highly liquid repellent areas 310*c* and 310*d* have a liquid repellence higher than a liquid repellence of the surface of the substrate 310 and the insulating film 21. Moreover a common channel 312 is formed by dividing of the common channel defining surface 10*a* by the highly liquid repellent areas 310*c* and 310*d*, and furthermore, a plurality of ink channels 313 extending in the Y direction, and each branching from the common channel 312 is formed by dividing of the ink channel demarcating area 10*b* by the highly liquid repellent areas 310*c* and 310*d*. In FIG. 15, although only three ink channels 313 are shown, in reality, more than three ink channels 313 are arranged at equal intervals in the X direction as shown in FIG. 14.

A discharge port 308 from which the ink is discharged is formed at an end portion of each ink channel 313, on a side opposite to the common channel 312, and the plurality of discharge ports 308 is arranged in a row along the X direction. Moreover, ink flowed into the head 301 from the ink cartridge 53 is pressurized by the pressurizing mechanism described above, and is supplied from the common channel 312 to each ink channel 313. When the ink is supplied from the common channel 312 to each ink channel 313, since the liquid repellence of the highly liquid repellent area 310*c* is higher than the liquid repellence of the ink channel defining surface 10*b* (insulating film 21 and adjacent area 20), the ink flowed on the ink channel defining surface 10*b* does not enter the highly liquid repellent area 310*c*.

Moreover, in each ink channel 313, the ink is flowed in a direction from the common channel 312 to the discharge port 308. Furthermore, the ink is discharged on to the printing paper P from the discharge ports 308 of the ink channels 313.

On the ink channel defining surface 10*b* of each ink channel 313, an insulating film 21 (hatched area in the form of a mesh in FIG. 15) extending from the discharge port 308 toward an upstream side in the direction of ink flow, and an adjacent area 20 which is an area having the liquid repellence lower than that of the insulating film 21, and which is adjacent to the insulating film 21 at the upstream side in the direction of ink flow, are formed. Here, the insulating film 21 has a rectangular shape in a plan view, and is formed along an entire area in a direction of width (X direction) of the ink channel defining surface 10*b*. In other words, the insulating film 21 is extended up to substantially the same position as the discharge port 308 in the direction of ink flow, on the ink channel defining surface 10*b*. Moreover, a control electrode 18 is formed between the insulating film 21 and the substrate 310. In other words, the control electrode 18 is covered by the insulating film 21.

Since a structure and a function of the control unit 70 is substantially the same as the structure and the function of the control unit 70 in the first embodiment, the description of the structure and function is omitted. Moreover, since an operation of the head 301 is substantially the same as the operation of the head 1 in the first embodiment, the description of the operation is omitted.

According to the printer 360 described above, due to the occurrence of the electrowetting effect according to the electric potential of the control electrode 18, it is possible to control as to whether or not to discharge the ink from the discharge port 308. Consequently, it is possible to have at a low cost, the head 301 having a simple structure and a high degree of integration. Moreover, since an energy required for discharging the ink from the discharge port 308 is low, it is possible to reduce the size and cost of electric components.

Moreover, in the second embodiment, since the cover member which divides the common channel 312 and the ink channel 313 is unnecessary, a cost of the head 301 can be reduced further. Since, the common channel 312 and the ink channel 313 are exposed, it is easy to carry out maintenance of the common channel 312 and the ink channel 313. Furthermore, it is possible to form the common channel 312 and the ink channel 313 by a simple method of forming the highly liquid repellent areas 310*c* and 310*d* on the surface of the substrate 310. Moreover, it becomes extremely easy to improve the degree of integration of the ink channel 313 by forming the highly liquid repellent areas 310*c* and 310*d* by a printing process for example.

The exemplary embodiments and modified embodiments of the present invention have been described above. However, the present invention is not restricted to the above mentioned embodiments and modified embodiments, and various design modifications which fairly fall within the scope of the basic teaching herein set forth can be made. For example, in the first embodiment, the partition walls which divide the common channel 12 and the ink channels 13, 113, and 213 are formed on the cover member 11. However, a part of such partition walls maybe formed on the substrates 10, 110, and 210.

Moreover, in the first embodiment and the second embodiment, the earth electrode 17 is formed on the common channel defining surface 10*a* of the common channels 12 and 312. However, such earth electrode which grounds (connects to earth) the ink may be formed on other area of the heads 1, 101, 201, and 301, or the earth electrode may not be provided.

Furthermore, in the first embodiment and the second embodiment, the ink cartridge 53 functions as the pressurizing mechanism pressurizing the ink by installing such that there occurs to be the water head difference between the ink stored in the ink cartridge 53 and the ink in the heads 1, 101, 201, and 301. However, the pressurizing mechanism may be provided by using a pressurizing unit such as a pump, or the pressurizing mechanism may not be provided.

Moreover, in the first embodiment, the cross-sectional shape of the ink channels 13, 113, and 213 is rectangular. However, the cross-sectional shape of the ink channels may be other shape such as a circular shape and an elliptical shape.

Furthermore, in the first embodiment and the second embodiment, the surface of the substrates 10, 110, 210, and 310 which is in contact with the ink is non-conductive (has an insulating property). However, when the control electrodes 18, 118, and 218, and the ink are insulated, the surface of the substrate in contact with the ink may be let to be electroconductive.

In the first embodiment and the second embodiment, the edge of the insulating films 21, 121, and 221, on the downstream side in the direction of ink flow is extended in the direction orthogonal to the direction of ink flow, and is formed to match perfectly with the discharge port 8. However, the edge of the insulating films 21, 121, and 221 may be formed slightly away from the discharge port 8. Moreover, the edge of the insulating films 21, 121, and 221 on the downstream side in the direction of ink flow may be inclined with respect to the direction orthogonal to the direction of ink flow such that a distance of the edge from the discharge port 8 increases gradually.

Moreover, in the first embodiment and the second embodiment, in a plan view, the control electrodes 18, 118, and 218 are formed along the entire area in the direction of width of the ink channel. However, the control electrode may be formed only on a part of the ink channel in the direction of width. Furthermore, a plurality of control electrodes may be formed corresponding to each ink channel. When the plurality of control electrodes is formed, it is preferable to perform the control such that the control electrodes in each ink channel are at the same electric potential.

In the first embodiment and the second embodiment, the example in which the present invention is applied to the printer discharging the ink is shown. However, the present invention is also applicable to an apparatus which discharges an electroconductive liquid other than ink, such as a liquid discharging apparatus discharging a liquid such as a medicinal solution, a chemical solution, an electroconductive solution for forming wiring, and a UV (ultraviolet) resin solution. Furthermore, a surface on to which the liquid is discharged is not restricted to a surface of a paper such as the printing paper P, and may be a solid surface of glass, polyimide, and silicon etc.

The liquid discharging apparatus of the present invention, as described above, is capable of controlling the liquid repellence of each insulating film by controlling a voltage between each electrode and the liquid by an electric potential control mechanism. Accordingly, for controlling as to whether or not to discharge the liquid from each discharge port, the liquid discharging apparatus of the present invention can be used as a valve (regulator valve) which controls the flow of a liquid. Or, it is possible to control an amount and/or a flow speed of a liquid discharged from the liquid discharging apparatus by controlling as to from how many channels from among a plurality of ink channels, the ink (liquid) is made to flow. Consequently, it is possible to use the liquid discharging apparatus of the present invention as a mass flow controller (MFC) which adjusts the amount and/or flow speed of the liquid which is discharged.

What is claimed is:

1. A liquid discharging apparatus which discharges a liquid having an electroconductivity, comprising:

a liquid channel which has a discharge port and through which the liquid flows;

an electrode which is formed on a predetermined surface of the liquid channel, and which is extended from the discharge port toward an upstream side of a direction of a flow of the liquid;

an insulating film which is extended from the discharge port toward the upstream side of the direction of the flow on the predetermined surface of the liquid channel, and which is formed on the predetermined surface of the liquid channel entirely in a width direction orthogonal to the direction of the flow, and which covers the electrode;

an adjacent area which is adjacent to the insulating film on the predetermined surface of the liquid channel on the upstream side of the direction of flow; and an electric potential control mechanism which controls an electric potential of the electrode;

wherein a liquid repellence of the insulating film is higher than a liquid repellence of the adjacent area.

2. The liquid discharging apparatus according to claim 1, wherein the electric potential control mechanism controls the electric potential of the electrode by switching the electric potential to a first electric potential and a second electric potential, and the first electric potential is an electric potential which sets the liquid repellence of the insulating film such that the liquid is prevented from being discharged from the discharge port by forming a meniscus of the liquid at a boundary between the insulating film and the adjacent area, and the second electric potential is an electric potential which lowers the liquid repellence of the insulating film such that the liquid is discharged from the discharge port without forming the meniscus of the liquid, at the boundary between the insulating film and the adjacent area.

3. The liquid discharging apparatus according to claim 1, wherein the liquid channel includes a plurality of individual liquid channels formed at intervals.

4. The liquid discharging apparatus according to claim 3, wherein:

the individual liquid channels includes individual discharge ports respectively, and the individual liquid channels are arranged such that the individual discharge ports are arranged in a row; and the liquid channel further includes a common channel which is connected to the individual liquid channels.

5. The liquid discharging apparatus according to claim 1, wherein a cross-sectional area of the liquid channel is decreasing toward the discharge port.

6. The liquid discharging apparatus according to claim 5, wherein:

the liquid channel includes a uniform area having a uniform cross-sectional area along the direction of the flow, and a reduction area having a cross-sectional area reducing gradually toward the discharge port; and the insulating film is formed on the reduction area.

7. The liquid discharging apparatus according to claim 1, wherein a width of the liquid channel in a direction orthogonal to the direction of flow is narrow at a boundary between the insulating film and the adjacent area.

8. The liquid discharging apparatus according to claim 7, wherein the direction orthogonal to the direction of the flow is a direction parallel to a direction of plane of the predetermined surface on which the insulating film is formed.

9. The liquid discharging apparatus according to claim 1, wherein:

the liquid channel is formed by a substrate in a form of a plate, and a cover member in which a recess is formed, and the predetermined surface of the liquid channel is formed in the substrate; and a surface of the liquid channel excluding the predetermined surface is formed in the recess in the cover member.

10. The liquid discharging apparatus according to claim 1, wherein:

the liquid channel includes a plurality of individual ink channels formed to be adjacent to each other and with a gap; and a highly liquid repellenct area having a liquid repellence higher than the liquid repellence of the insulating film and the adjacent area is formed in the gap between the adjacent individual ink channels, and each of the individual liquid channels are defined by the highly liquid repellent area.

11. The liquid discharging apparatus according to claim 10, wherein the liquid having the electroconductivity is ink, and the liquid discharging apparatus is an ink head.

12. The liquid discharging apparatus according to claim 1, further comprising a ground electrode which is grounded all the time, and which is in contact with the liquid.

13. The liquid discharging apparatus according to claim 1, further comprising a pressurizing mechanism which applies pressure to the liquid so that the liquid flows toward the discharge port.

14. The liquid discharging apparatus according to claim 1, wherein the liquid having the electroconductivity is ink, and the liquid discharging apparatus is an ink head.

* * * * *